US005186601A

United States Patent [19]

Treece et al.

[11] Patent Number: 5,186,601

[45] Date of Patent: Feb. 16, 1993

[54] COMPRESSOR SHROUD AIR BLEED ARRANGEMENT

[75] Inventors: William D. Treece, La Mesa; Robert C. Thompson, San Diego, both of Calif.

[73] Assignee: Sundstrand Corp., Rockford, Ill.

[21] Appl. No.: 760,625

[22] Filed: Sep. 16, 1991

[51] Int. Cl.[5] ..... F01D 1/12

[52] U.S. Cl. ..... 415/58.4; 415/173.1

[58] Field of Search ..... 415/52.1, 58.2, 58.3, 415/58.4, 134, 135, 138, 115, 116, 173.1, 173.3, 174.2, 168.1, 169.1

[56] References Cited

U.S. PATENT DOCUMENTS

| | | | |
|---|---|---|---|
| 4,743,161 | 5/1988 | Fisher et al. | 415/58.4 |
| 4,981,018 | 1/1991 | Jones et al. | 415/58.3 |
| 5,147,178 | 9/1992 | Treece | 415/58.4 |

*Primary Examiner*—Edward K. Look
*Assistant Examiner*—James A. Larson
*Attorney, Agent, or Firm*—Harold A. Williamson

[57] ABSTRACT

The invention is directed to a compressor that recirculates bleed air by way of a fluid distributing unit which is adapted to redirect and uniformly distribute the air bled through passages in a compressor shroud section across a cross-sectional area of a compressor's inlet region to provide uniform distribution of the bleed air into the compressor's impellar to thereby increase efficiency of the compressor.

3 Claims, 2 Drawing Sheets

COMPRESSOR SHROUD AIR BLEED ARRANGEMENT

FIELD OF THE INVENTION

This invention relates to rotary machines used as compressors, and more particularly to an axial inflow, radial outflow rotary compressor.

BACKGROUND OF THE INVENTION

Flow ranges for centrifugal compressors generally, and the ranges over which they may operate specifically, are dictated by the stalling characteristics of the compressor impeller and a diffuser which receives compressed air from the impeller. The stalling characteristics in turn are intrinsically controlled by contours of the impeller blades as well as Mach numbers achieved during operation.

Although various centrifugal compressors may utilize either vaned or vaneless diffuser systems, where maximum efficiency at high Mach numbers is required, the use of vaned diffuser systems becomes almost mandatory. This in turn means that the impeller and diffuser must be matched at peak efficiency flow conditions.

In such cases, the vaned diffuser tends to be the flow controlling component in that the overall Mach number occurring therein generally is higher than that of the compressor inducer which operates with a larger variation of Mach numbers over the radius of the blades extending from a hub of the impeller to the compressor shroud in an axial inflow, radial outflow centrifugal compressor. The diffused flow from the impeller in such a case, and non-uniform entrance conditions which result, further aggravate stalling sensitivity. To attain a large flow range requires that the impeller and the diffuser must be capable of operating into "positive incidence" or stalled regions to flows where compressor surge is eventually triggered. Compressor surge is generally believed to stem from operation on an unstable portion of the overall compressor characteristic (a positive slope portion) where the impeller static pressure ratio decreases with decreasing flow. Thus, one effective method of increasing compressor operating range is to provide sufficient impeller stability so that the downstream diffuser can operate well into its positive incidence zone, even though the diffuser static pressure recovery versus flow characteristic exhibits a positive slope. Impeller stability is conventionally provided by the use of blade tip backsweep since the increased backsweep provides a more negative sloped static pressure rise versus flow characteristic. However, increasing the tip backsweep increases stresses appearing in the impeller blade and/or hub.

Present-day advanced aircraft require auxiliary power units (APUs) as a supply of electrical, hydraulic, and pneumatic power to secondary power systems of the aircraft. Generally speaking, the APUs are gas turbine units and must be highly reliable. In addition, compactness is also required. Most suitably, the APUs are then based upon a single shaft, constant speed, gas turbine having a high specific speed, single stage centrifugal compressor, a reverse flow annular combustor, and a single stage radial or axial inflow turbine. Shaft power is utilized to drive electrical generators and/or pumps and compressor bleed air extracted from the system prior to combustion to provide pneumatic power. For high bleed air output, it is necessary to design the compressor to operate adjacent to its maximum flow point, that is, near a so-called "choke" condition. The extraction of increasing amounts of shaft power at constant speed and constant turbine inlet temperatures from the choke point incrementally displace the compressor operating point to lower flows and are eventually limited by encroachment upon the compressor surge line.

The assignee of the instant invention has in the past embraced the problems as defined herein before and defined a solution as described in now issued U.S. Pat. No. 4,981,018. This solution called for a compressor construction wherein a compressor hub and associated blades of the impeller formed thereby are surrounded by an annular shroud. Bleed passages in the shroud which are angled in the direction of flow, both axially and radially, have been found to improve efficiency.

While the invention of U.S. Pat. No. 4,981,018 advanced the state of the art, low operating temperature environmental operating conditions conspired to detract from the turbomachine's overall efficiency.

The shroud bleed air which has been warmed during compression is reingested by the compressor at the compressor inlet. This warmed bleed air appears to stratify toward a compressor outer shroud wall. This warmed stratified bleed air enters an outer flow path of the compressor's inducer section and causes performance penalties to the turbomachine.

In cold ambient air during startup, cold air is drawn into the compressor inlet and in so doing cools inlet support struts and related structure in such a manner as to cause the compressor front shroud structure to pull away from the compressor rotor which further deteriorates the turbomachine's performance.

The invention to be described more fully hereinafter solves the problems just enumerated in an exceptionally simple manner.

SUMMARY OF THE INVENTION

The principal object of the invention is to provide a new and improved rotary compressor. More specifically, the invention is directed to a compressor which includes a plurality of compressor impeller blades mounted on a rotating hub within a compressor housing, which housing has a compressor inlet region. The compressor blades and the compressor housing cooperate to compress and direct fluid from the inlet region along a path defined by a compressor shroud section of the compressor housing. A portion of the fluid along the path is bled through passages in the compressor shroud section. The compressor embodying the invention includes a fluid distributing unit adapted to receive, redirect, and uniformly distribute fluid bled through the passages in the compressor shroud section across a cross-sectional area of the compressor inlet region to provide uniform distribution of bleed fluid in the compressor impeller blades to thereby increase the efficiency of the compressor.

In an exemplary embodiment of the invention, the fluid distributing unit is comprised of a fluid directing chamber which is adapted to receive and redirect the fluid bled through the passages in the compressor shroud.

Fluid delivering ducting, which is in fluid communication with the fluid directing chamber, receives the bleed fluid and uniformly distributes the bleed fluid across a cross-sectional area of the compressor inlet region. In a highly preferred embodiment, the fluid delivery ducting takes the form of a plurality of hollow, tubular compressor support struts, each of which is provided with outlet openings adjacent the inlet region of the compressor.

One embodiment of the invention contemplates that the outlet openings in the support struts, just noted, are configured to introduce preswirl into the fluid entering the compressor inlet region. The openings in the hollow tubular support struts are located radially adjacent the compressor inlet region to provide maximum preswirl into the compressor inlet region during minimum flow of the fluid through the compressor, whereas the openings further provide minimum preswirl into the compressor inlet region during maximum flow of the fluid through the compressor.

An additional advantage of the invention resides in the fact that the bleed fluid is warmed during its compression, and its passage through the support struts warms the struts and prevents a front compressor shroud secured to the struts from pulling away from the compressor impeller during cold ambient compressor starting.

Other objects and advantages will become apparent from the following specification taken in conjunction with the accompanying drawings.

DESCRIPTION OF THE PREFERRED EMBODIMENT

Figure 1:
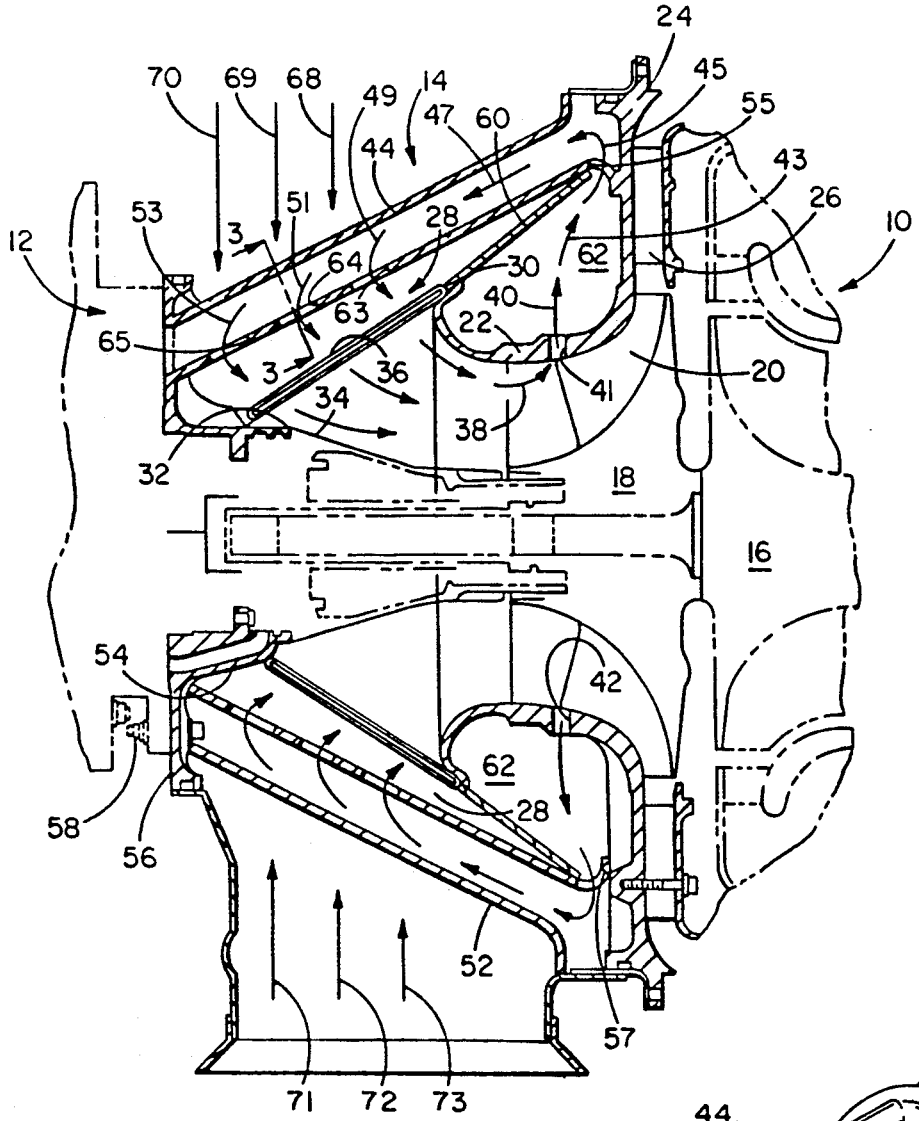
FIG. 1 is a fragmentary sectional view of an air breathing compressor made in accordance with the invention.

Reference is now made to FIG. 1 which illustrates in cross-sectional detail a compressor made in accordance with the invention, as well as a portion of a radial turbine engine generally designated 10, which is shown in phantom outline. A transmission 12, shown schematically, has interposed between the radial turbine engine 10 and the transmission 12 a compressor 14.

The engine 10 includes a turbine rotor hub 16 and the compressor 14 has a compressor hub 18 which mounts a plurality of compressor blades 20 to define a rotary, radial outflow centrifugal compressor. The blades 20 are closely adjacent a fixed, compressor shroud section 22, which shroud section forms a portion of a compressor housing 24. A conventional diffuser 26 receives air compressed by the blades 20. The diffuser 26 is supported in part by the compressor housing 24.

The compressor 14 includes an inlet region 28 that exists between a front edge 30 of the compressor housing shroud section 22 and a front edge 32 of an inlet throat wall 34. It should be readily appreciated that the inlet region 28 is annular in nature. A screen 36 is provided across the inlet region 28 to ensure particulate matter in the atmosphere is not ingested by the compressor and delivered to the turbine engine 10. Air drawn in through the inlet region moves along a path 38 defined by the compressor shroud section 22. A portion 40 of the air along path 38 is bled through bleed passages 41, 42 in the compressor shroud section 22.

Figure 2:
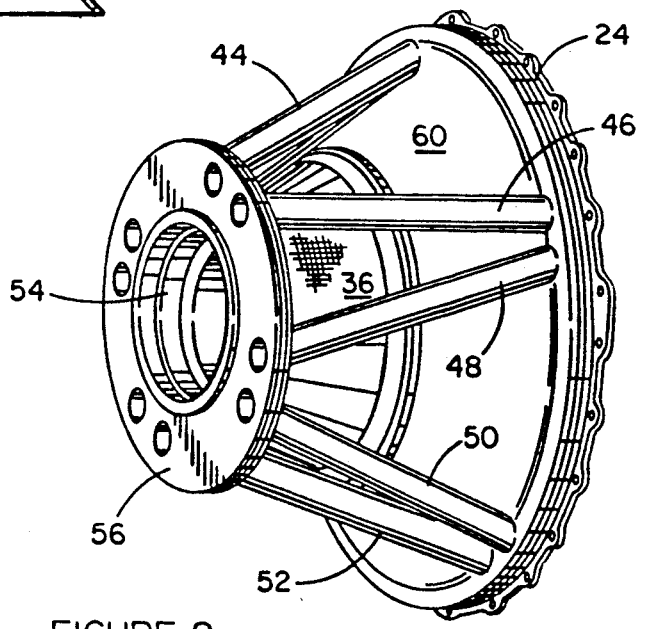
FIG. 2 is a three-dimensional illustration of a geodesic tubular compressor strut structure shown in section in FIG. 1, which strut structure includes fluid distribution openings of the invention.

A series of tubular support struts 44, 46, 48, 50, and 52 (see FIGS. 1 and 2) is integrally secured at the left hand end as FIGS. 1 and 2 are viewed, to a ring-like structure 54 that includes a radially outwardly extending, peripheral flange 56. The peripheral flange 56 is secured by fasteners, one of which 58 is shown, to the transmission.

The right-hand ends of struts 44, 46, 48, 50, and 52 are integrally made a part of the compressor housing 24 by welding or any other suitable means. The struts form a geodesic turbine engine mount structure that is light in weight and provides substantial torsional rigidity.

A frusta conically-shaped annular shroud bleed baffle 60, positioned as shown between front edge 30 and the housing 24, creates an annular bleed air directing chamber 62 which receives bleed air via passages 41, 42. While only two bleed Passages 41, 42 are shown in FIG. 1, similar passages are arrayed around the shroud section 22.

Attention is now directed to support strut 44 as seen in FIG. 1. The structure and function of strut 44 is the same as the other struts depicted in FIGS. 1 and 2. The struts collectively function as a fluid distributing unit or means where, in the case at hand, the fluid is bleed air that has entered the bleed air directing chamber 62 via the passage 41 in the compressor shroud section 22. Air flow arrows 43, 45, 47, 49, 51, and 53 graphically depict a flow path of bleed air from bleed air directing chamber 62.

It will be observed that each tubular support strut, such as struts 44 and 52 (FIG. 1), has a strut inlet opening 55 and 57 at a strut end adjacent the compressor housing 24. Bleed air passes through the strut inlet openings as indicated by the air flow arrows. The support struts 44, 46, 48, 50, and 52 may be thought of functionally as ducts or duct means which are/is integrally secured to the compressor housing 24.

Each of the struts or ducts, e.g., strut 44, is provided with a plurality of outlet openings 63, 64, 65 to uniformly distribute the bleed air in the strut 44 uniformly across the cross-sectional area of the compressor inlet region which results in the compressor operating at increased efficiency. It will be observed that the outlet openings 63, 64, 65 are located radially adjacent the compressor inlet region 28.

Ambient inlet air flow into the compressor as is indicated by arrows 68, 69, 70, 71, 72, 73 which are shown passing struts 44 and 52 on the way to inlet region 28.

Figure 3:
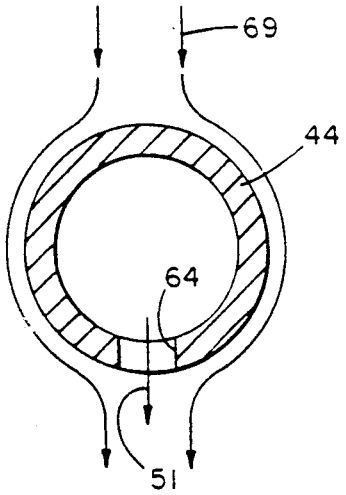
FIG. 3 is a cross section of a tubular support strut and compressor fluid inlet flow paths which depict a condition with no preswirl into a compressor.

Attention is now directed to FIG. 3 which illustrates ambient inlet air flow 69 around strut 44 as well as the mixing of bleed air flow 51 from outlet opening 64 prior to entry into the inlet region 28 of FIG. 1.

Figure 4:
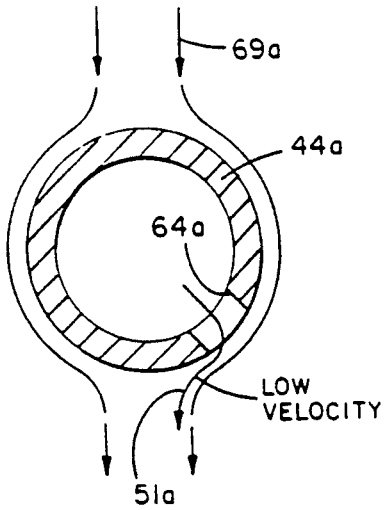
FIG. 4 is a cross section of a tubular support strut taken along line 3—3 in FIG. 1.
Figure 5:
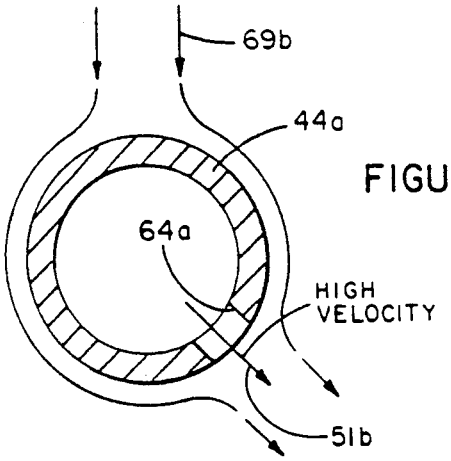
FIG. 5 is a cross section of another embodiment of a feature of the invention.
Figure 7:
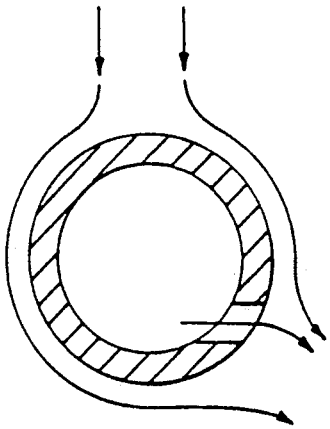
FIG. 7 is a cross section of another embodiment of a feature of the invention.

FIGS. 4, 5, and 7 are directed to other embodiments of a feature of the invention. Reference numerals for FIGS. 4 and 5 will carry the same designation where the numerals relate to similar structure and air flows. However, a suffix "a" will be added to characterize the feature of the embodiment of the invention being described. FIG. 7 illustrates a variation of the invention shown in FIG. 5. When FIGS. 4 and 5 are compared to FIG. 3, it will be appreciated that the strut **44*a* has an outlet opening disposed at an angle to the ambient inlet air flow 69***a*, which results in the bleed air flow 51*a* exiting the strut 44*a* via outlet opening 64*a* in the manner shown. This feature of the invention contemplates that bleed air may be vented from the struts in a manner to introduce preswirl in the compressor.

The illustration presented by FIG. 4 is intended to represent ambient inlet air flow 69*a* and strut outlet bleed air flow 51*a* when the compressor is experiencing near maximum through-flow. Under this described condition, the strut outlet bleed air flow 51 is of a low velocity and does not induce in the inlet air flow 69*a* preswirl. When compressor flow is reduced, the shroud bleed flow and strut outlet bleed flow 51*b* naturally increase as is depicted in FIG. 5. The high velocity bleed flow 51*b* induces a maximum preswirl into the compressor.

Figure 6:
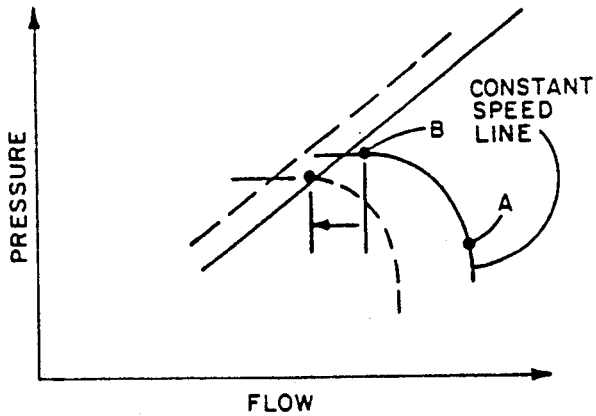
FIG. 6 depicts a plot of pressure versus flow for various operating conditions of a compressor.

Referring now to FIG. 6 where there is depicted a plot of pressure versus flow for various operation conditions of the compressor. The point "A" on the constant speed line represents the no preswirl condition depicted in FIG. 4, whereas point "B" on the same constant speed line represents the maximum preswirl condition illustrated in FIG. 5. The increase shroud bleed air causes the struts to become turning vanes for the preswirl. This just described action moves the surge line (shown dashed) to lower flow, thereby extending the compressor rangeability.

Although this invention has been illustrated and described in connection with the particular embodiments illustrated, it will be apparent to those skilled in the art that various changes may be made therein without departing from the spirit of the invention as set forth in the appended claims.

We claim:

1. A compressor for compressing fluid by means of a plurality of compressor blades mounted on a rotating hub within a compressor housing having a compressor inlet region, said compressor blades and said compressor housing cooperating to comprises and direct said fluid along a path defined by a compressor shroud section of said compressor housing, a portion of said fluid along said path being bled through passages in said compressor shroud section, said compressor comprising:

a fluid distributing means including;

a fluid directing means adapted or receiving and redirecting said fluid bled through said passages in said compressor shroud section; and a fluid delivering means in fluid communication with said fluid directing means for receiving said bleed fluid redirected by said fluid directing means, said fluid delivering means adapted for uniformly distributing said bleed fluid received from said fluid directing means across a cross-sectional area of said compressor inlet region to provide uniform distribution of said bleed fluid into said compressor to thereby increase efficiency of compressing said fluid, said fluid directing means includes an annular compressor shroud bleed baffle, said annular compressor shroud bleed baffle cooperating with said compressor shroud section to redirect said fluid bled from said compressor shroud section to said fluid delivering means to provide for recirculation of said bleed fluid in said compressor, said fluid delivering means further including a duct means integrally secured to said compressor housing, said duct means in fluid communication with said fluid directing means to receive said bleed fluid redirected from said fluid directing means, said duct means comprised of a plurality of ducts, said ducts including a plurality of openings, said openings adapted to uniformly distribute said bleed fluid received by said ducts, said openings distributing said bleed fluid uniformly across said cross-sectional area of said compressor inlet region to increase efficiency of compressing said fluid, said openings being further adapted to introduce preswirl into said fluid entering said compressor inlet region, said openings of said ducts located radially adjacent to said compressor inlet region to provide maximum preswirl into said compressor inlet region during minimum flow of said fluid through said compressor, said openings further providing minimum preswirl into said compressor inlet region during maximum flow of said fluid through said compressor.

2. The compressor of claim 1 wherein said ducts are cylindrical in nature.

3. The compressor of claim 2 wherein said ducts are in a form of struts which support said compressor.

* * * * *